United States Patent [19]

Chamberlain

[11] 4,342,071

[45] Jul. 27, 1982

[54] UNDERWATER LIGHTING

[75] Inventor: William B. Chamberlain, Aberdeen, Scotland

[73] Assignee: Challenger Diving Limited, Aberdeen, Scotland

[21] Appl. No.: 177,132

[22] Filed: Aug. 11, 1980

Related U.S. Application Data

[63] Continuation of Ser. No. 956,967, Nov. 2, 1978, abandoned.

[30] Foreign Application Priority Data

Nov. 8, 1977 [GB] United Kingdom ..... 46528/77

[51] Int. Cl.[3] ..... F21V 31/00

[52] U.S. Cl. ..... 362/158; 362/184; 362/307; 362/185; 362/310; 362/200; 362/375; 362/223; 362/225; 362/267; 362/277

[58] Field of Search ..... 362/158, 184, 185, 200, 362/223, 225, 267, 297, 307, 310, 375

[56] References Cited

U.S. PATENT DOCUMENTS

| | | | |
|---|---|---|---|
| 2,337,437 | 12/1943 | Allen | 362/225 |
| 2,740,038 | 3/1956 | Carrie | 362/267 |
| 2,906,863 | 9/1959 | Ritter | 362/267 |
| 3,169,205 | 2/1965 | Kestner et al. | 174/50.5 X |
| 3,192,379 | 6/1965 | De Garmo | 362/267 |
| 3,302,014 | 1/1967 | Moore et al. | 362/267 |
| 3,515,862 | 6/1970 | Spivey | 362/267 |
| 3,539,797 | 10/1970 | Brindley et al. | 362/158 |
| 3,609,337 | 9/1971 | Adra et al. | 362/306 X |
| 3,949,212 | 4/1976 | Larrimore | 362/267 X |
| 4,138,716 | 2/1979 | Muhlethaler et al. | 362/267 X |
| 4,186,432 | 1/1980 | Hamacher | 362/267 X |
| 4,282,564 | 8/1981 | McJunkin, Jr. et al. | 362/225 X |

FOREIGN PATENT DOCUMENTS

| | | | |
|---|---|---|---|
| 873458 | 7/1961 | United Kingdom | 362/267 |
| 1456578 | 11/1974 | United Kingdom | 362/158 |
| 250313 | 6/1968 | U.S.S.R. | 362/267 |
| 274021 | 9/1970 | U.S.S.R. | 362/267 |

*Primary Examiner*—Peter A. Nelson

*Attorney, Agent, or Firm*—Howard H. Darbo

[57] ABSTRACT

A lamp capable of underwater use comprises a rectangular acrylic body with elongate V-shaped recesses in a major surface each receiving an elongate Beta-light. An acrylic cover plate is sealed to the major surface and the body is secured to a steel backing plate with a neoprene layer between to help dissipate shock loadings. The sides of the recesses include an angle of 78° to enhance reflection and may be formed by a reflective lining. The Beta-lights can be received in the grooves by shock absorbent O-rings grouped in pairs with adhesive in between. In a modification a disc-shaped Beta-light is encapsulated and received in a body formed by pour molding which is closed by a cap which is ultrasonically welded into place.

12 Claims, 19 Drawing Figures

FIG.12.
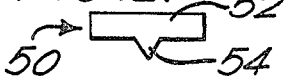
FIG.13.
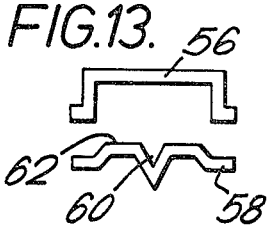
FIG.14.
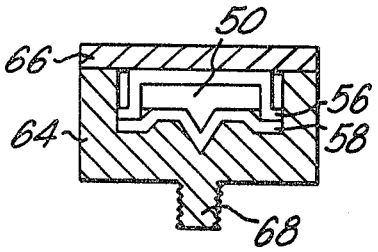
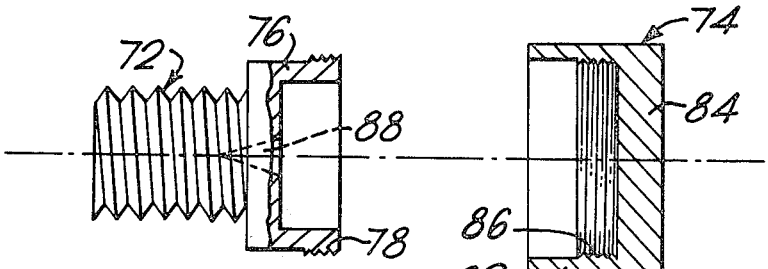
FIG.15.
FIG.16.
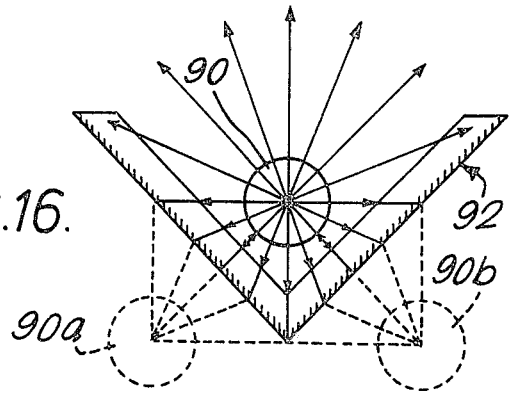

UNDERWATER LIGHTING

This is a continuation of application Ser. No. 956,967, filed Nov. 2, 1978, and now abandoned.

This invention relates to a lamp including a self-energising light source.

A convenient form of self-energising light source is the so-called beta-light, which comprises a sealed transparent or translucent shell having an internal phosphor coating and containing tritium gas which emits beta radiation. The beta particle emission from the tritium gas activates the phosphor coating causing this to emit visible light. A light source of this kind requires no external power and can be designed to have a useful life of up to twenty years. The light source cannot however be used in adverse environment alone but must be provided with a housing capable of providing adequate protection.

It is accordingly an object of the invention to provide a lamp having one or more self-energising light sources contained in a housing adapted to protect the light source or sources against adverse environments such as environments in which the lamp is exposed to shocks including explosive shocks and high ambient pressures.

It is a particular object of the present invention to provide a lamp comprising a housing containing at least one self-energising light source which is capable of use in underwater environments.

It is a further object of the invention to provide a lamp in which a housing encloses self-energising light source means and means for maximizing the light output of the light source means in one or more predetermined directions.

It is also an object of the invention to provide a convenient and economical method of manufacturing and assembling a housing for at least one self-energising light source.

It is a further object of the invention to provide a lamp having a housing in which one or more self-energising light sources are received in a shock absorbent manner.

In accordance with one aspect of the invention, there is provided a lamp comprising one or more self-energising light sources mounted in a housing, the housing comprising a body portion and a cover portion which co-operate to locate the or each light source therewithin, and resilient material disposed within the housing to provide a shock-absorbent mounting for the or each light source, the housing portions being sealed together.

The lamp housing may be provided with a light-reflective insert. An individual insert may be provided for each light source, when there is more than one, but preferably a unitary insert is provided in these circumstances.

The insert is preferably shaped so as to provide mechanical retention of the light source, and in particular when the light source is of substantially cylindrical shape the insert may have a substantially V-shaped cross-section. The housing is conveniently to at least a major extent of acrylic resin, preferably normalized in manufacture, and annealed after the shaping operations needed to form the housing. The housing can be permanently sealed by welding, preferably ultrasonically, or by adhesively bonding together its component parts after insertion of the or each light source.

The or each light source is preferably received in a recess in the housing of the invention which is shaped to afford optimum light distribution, for example, transmission, reflection and refraction of light from the light sources in a single preferred direction. The light sources are mounted in the recesses by shock resistant elements and the housing is advantageously provided with shock absorbing mounting means.

In accordance with another aspect of the present invention, there is provided a lamp comprising a self-energising light source, a sealed two part plastics capsule within which the light source is securely located, and a two part mounting arrangement for the encapsulated light source comprising a first part arranged to receive the light source and a second part arranged to provide a cover for the first part.

The light source may be a beta light or other self-energising light source, and is preferably encapsulated in an acrylic or epoxy resin material. The capsule may be formed by joining together two moulded components to enclose the light source.

The encapsulated light source may be encased in the mounting arrangement as by pour centrifuge or pour casting under pressure.

This light source finds particular application underwater, but may also be used in other environments.

Lamps in accordance with the present invention will now be described, by way of example, with reference to the accompanying drawings, in which FIG. 1 is an exploded perspective view of one embodiment;

FIG. 12 is an elevation of a light source for an encapsulated lamp of a fourth embodiment;

FIG. 13 is an exploded sectional view of a capsule for the light source of FIG. 12;

FIG. 14 is a sectional elevation of the encapsulated lamp of FIG. 12 in its mounting arrangement;

FIG. 15 is a sectional elevation of an alternative mounting for an encapsulated light source.

FIGS. 16 to 18 are diagrammatic end elevations used for explaining the optical arrangement of a light source in a lamp housing.

Figure 1:
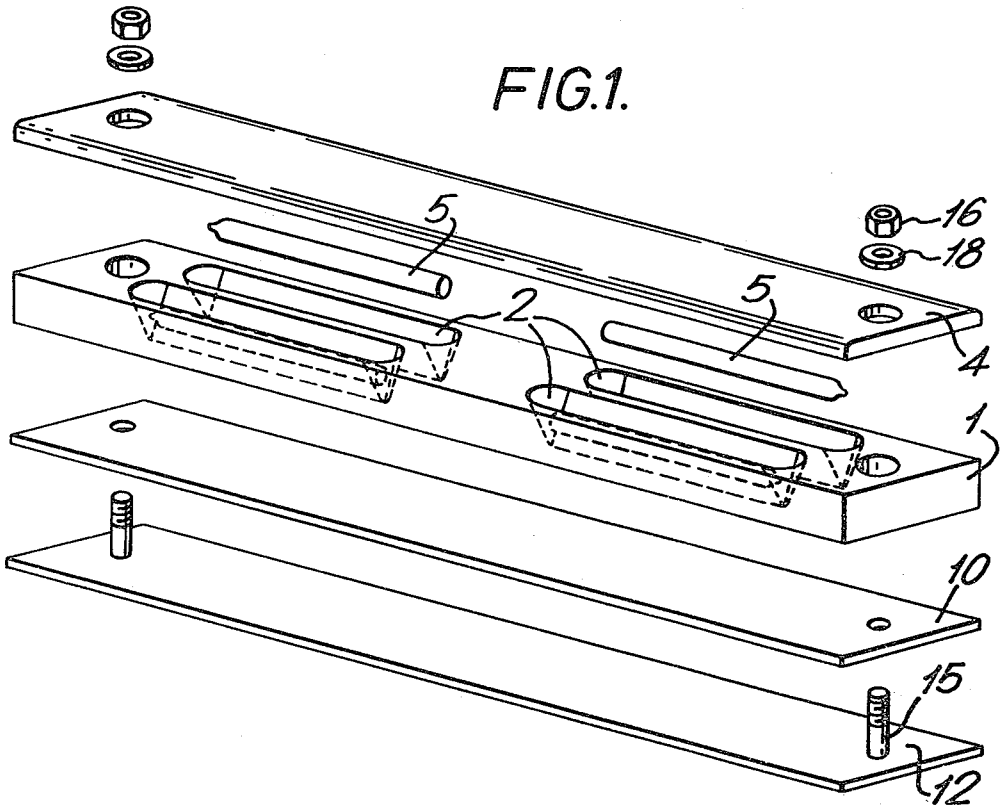

The lamp housing illustrated in FIGS. 1 to 5 comprises a lower body portion 1 in the form of an elongate generally rectangular block with four recesses 2 formed in its uppermost major surface, and an upper portion 4 in the form of a plate shaped to fit on the recessed major surface of the portion 1. The material of the body portions 1 and 4 is advantageously a cast thermoplastic acrylic resin for example that known by the trade name Oroglas, and the two portions are bonded together by a suitable cement. The material of the body has good dimensional stability, is extremely resistant to water, including sea water, and can be readily fabricated in sufficient thickness to provide good shock resistance. It has good optical properties and can be produced in transparent, translucent or coloured form.

A self-energising light source 5 of elongate generally cylindrical shape is received with clearance in each recess 2, each source preferably comprising a beta-light, that is, a glass or plastics tube containing tritium gas. Beta radiation, that is low energy electrons, emitted by the tritium gas activates a phosphor coating on the inner surface of each tube, causing light to be continuously emitted by the coating. Such lights are safe, being free of fire or external radiation hazard, and can resist vibration. They are not effected by oil, sea water or most corrosive materials. The light sources 5 are mounted in the recesses 2 by means of shock absorbent cups (not shown) at their ends. The light sources are thus protected from shocks experienced by the housing.

Figure 2:
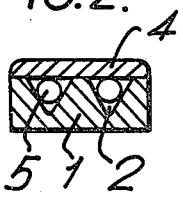
FIG. 2 is a sectional elevation of the lamp of FIG. 1.
Figure 3:
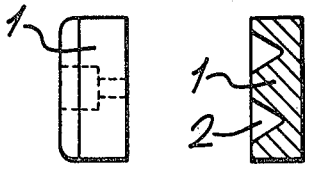
FIG. 3 is a section on the line B—B of FIG. 4.
Figure 4:
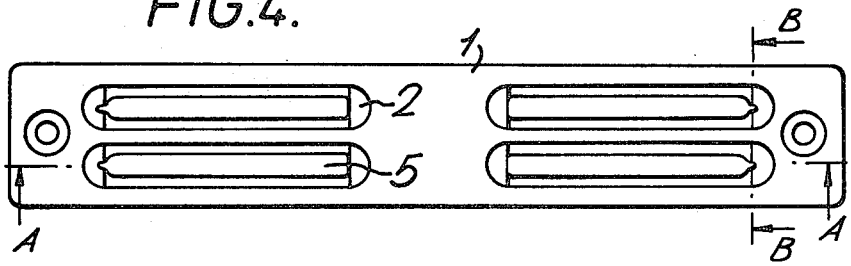
FIG. 4 is a front elevation of the lamp of FIG. 1.
Figure 5:
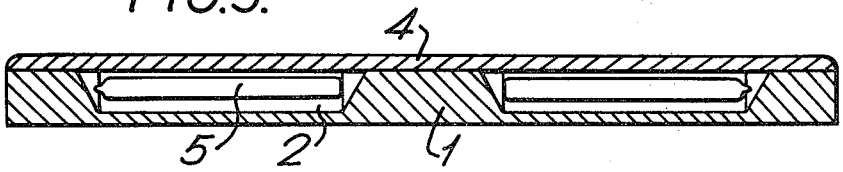
FIG. 5 is a section on the line A—A of FIG. 4.
Figure 6:
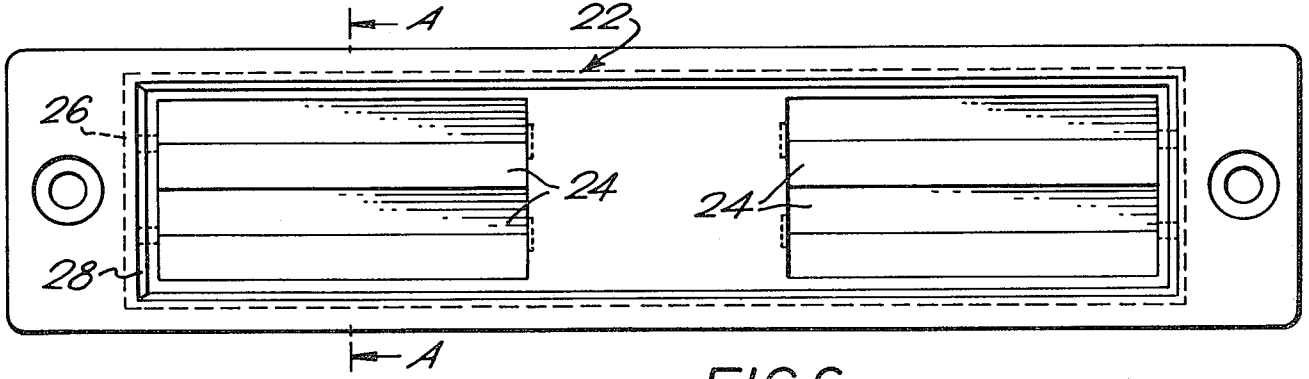
FIG. 6 is a plan view of a lamp housing of a second embodiment.
Figure 7:
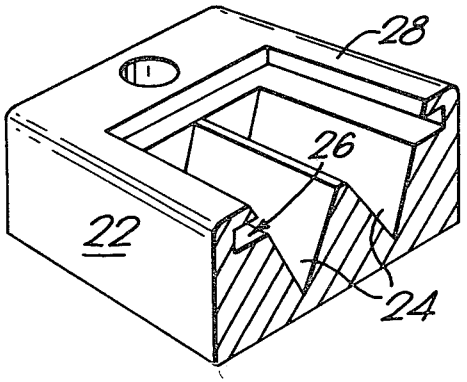
FIG. 7 is a section at line AA of FIG. 6.
Figure 8:
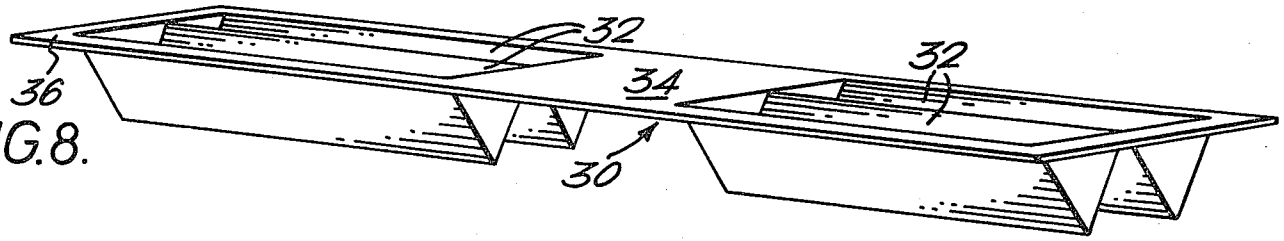
FIG. 8 is a perspective view of a light-reflective insert of the lamp of FIG. 6.
Figure 9:
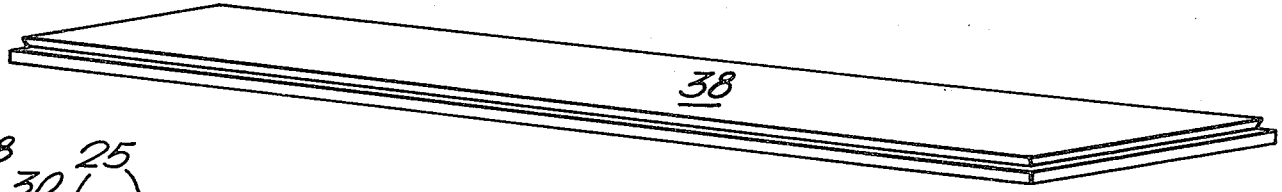
FIG. 9 is a perspective view of a face-plate of the lamp of FIG. 6.

As better appears from the cross-sectional view of FIG. 2, each of the recesses 2, when closed by the upper housing portion 4, has the cross-sectional shape of an equilateral triangle to assist direction of light upwardly by reflection from the two side walls.

The body 1, 4 is backed by an impact absorbent strip 10 preferably of pre-shrunk neoprene of the open cell type, to assist dissipation of shocks, and beneath this is a stainless steel backing plate 12. Both the strip 10 and the plate 12 are of the same rectangular shape as the lower body portion 1. A pair of bolts 15 or threaded pins upstanding from the backing plate 12 extend through aligned holes in the strip 10, and the body portions 1 and 4 so that these components of the lamp can be held in assembled condition by stainless steel lock nuts 16 and washers 18 received on the free ends of the bolts. The body portions 1 and 4 are recessed so that the nuts 16 do not protrude beyond the upper face.

The completed lamp module is readily produced by forming to shape the body portions 1, 4 from normalized cast thermoplastic acrylic resin sheet, that is, sheet that has been heated to 180° C. and allowed to cool to effect stress relief. The two portions are drilled and countersunk and are then buff polished to optical clarity. An annealing process next follows to ensure mechanical relief of stresses incurred in the engineering processes and also to protect the optical clarity of the housing against any tendency to crazing due to entrapment of vapour from the cement used to bond the two body portions together. Annealing can be effected by heating up to but not beyond 80° C. The light sources 5 are then fitted with shock resistant pads and inserted in the recesses 2 with a minimum clearance of 1.25 mm. The two body portions are then joined together by means of cement, suitably that known as Tensil 7. Bonding is effected under pressure to ensure exclusion of air from between the cement coated abutting faces of the body portions 1, 4.

The completed lamp module can be permanently secured in place for example on a sub-sea pipe handling frame or inside a hyperbaric chamber or a diving bell by direct welding of the backing plate 12. Instead, the module can be fixed for example around pipelines or the like by means of webbing received between the housing body portions and the backing plate, the studs 15 extending through holes in the webbing.

Referring to FIGS. 6 to 10, the lamp comprises a substantially-rectangular rubber-moulded housing 22 of 85° Shore Hardness. The housing provides four V-shaped recesses 24, which are of 70° to 80° and preferably 78° angle and each of which is arranged to receive a substantially-cylindrical beta-light source 25. The housing 22 defines a peripheral groove 26 that is overhung by a flexible lip 28.

A light-reflective insert 30 (FIG. 3) comprises four compartments 32 which are complementary to, and a push-fit in, the recesses 24 of the base of the housing 2. The compartments 32 are formed integrally with one another so as to have a substantially planar top surface 34, which has a peripheral flange 36 that is arranged to fit into the groove 26 of the housing 22. Thus, with the insert 30 disposed in the base of the housing 22, the exposed surface of the insert is arranged to reflect the light from the sources 25 upwards. The housing 22 is closed by a clear acrylic face-plate 38 that is flanged and shaped so as to sit on top of the insert 30 within the groove 26, be retained by the lip 28, and to extend around the lip 28 so as to provide a flush top surface of the housing 22. The reflective insert 30 and the face-plate 38 are fitted into the groove 26 under the lip 28 by flexing the lip 28.

Although the housing 22 is shown arranged to mount four light sources 25 therein, it will be appreciated that fewer or more sources may be accommodated. It will also be appreciated, that the mounting of the light sources 25 within the compartments, 32 of the insert 30 will be effected by means of shock-absorbent material.

It will also be appreciated that the face-plate 38 and/or the insert 30 may be sealed under the lip 28 in the groove 26 of the housing 22, for example to prevent the ingress of water or to protect the light sources 25 against excessive environmental pressure.

Figure 11:
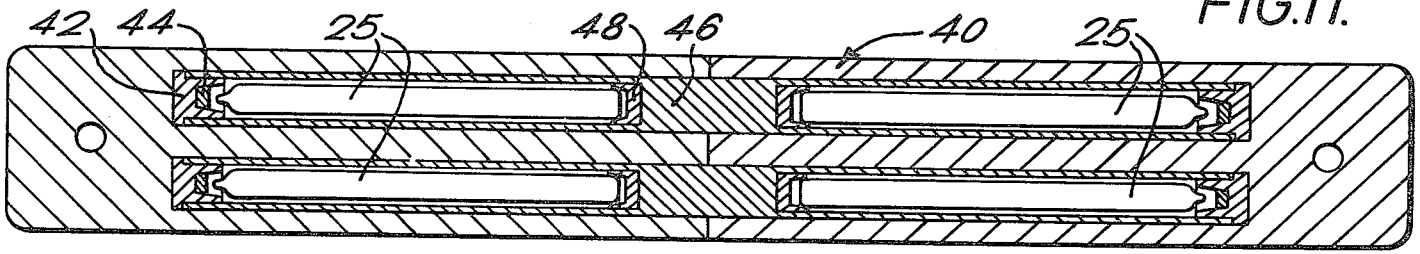
FIG. 11 is a plan view of a third embodiment of lamp housing.

FIG. 11 shows a modified form of the lamp in which four beta-lights 25 are located within channels in an acrylic housing 40. An end cap 42 is located at each end of each channel, and each cap 42 has a recess containing a shock-absorbent pad 44. Each pair of tubes 25 are spaced apart axially by a light module 46, which also provides a shock-absorbent bush 48 for resiliently mounting the tubes 25 at their ends opposed to the pads 44.

The fragile light sources 25 are therefore adequately protected in the housing 40, which provides an explosion-proof housing.

Features of the housing arrangement of FIG. 11 may be combined with those of the lamp housings of FIGS. 1 to 10.

Referring to FIGS. 12 to 14, a beta-light 50 serves as the light source of a lamp in accordance with another aspect of the present invention. The beta-light 50 comprises a substantially circular disc portion 52 and a substantially conical pip 54 extending axially from a lower face thereof. The light 50 has to be located in a mounting arrangement for use, but, in general, it is not able to withstand the temperatures and pressures associated with the moulding process that is used to provide the mounting. Accordingly, a preencapsulation step is carried out. FIG. 13 shows two parts 56, 58 of a capsule for receiving the light source 50. The capsule parts 56 and 58 are formed from an acrylic plastics material, shaped from an acrylic sheet by means of a die punch. The upper capsule part 56 is of substantially "top hat" shape and is arranged to fit over the disc portion 52 of the light source 50. The lower capsule portion 58 provides a conical depression 60 for receiving the pipe 54 of the light source 50, and provides an annular plateau 62 around the depression 60 for supporting the light source 50. After the light source 50 has been disposed within the capsule, the annular peripheral flanges thereof are cemented together.

FIG. 14 shows the encapsulated light source after it has been mounted in a body 64 formed by pour moulding around the capsule. The acrylic encapsulation of the light source 50 protects the source from damage during the pour moulding process. The assembly of the lamp is completed by the addition of a cap 66 of transparent material which is secured to the body 64, for example by ultrasonic welding.

The mould from which the body 64 is formed is arranged such that a threaded connecting stem 68 is provided by which the lamp may be mounted either in a correspondingly-threaded socket, or clamped to sheet material by means of a suitable retaining ring.

Although as shown the beta-light 50 has an upper portion 52 that is disc-shaped, this may alternatively be of hemispherical shape. In this case, the upper capsule part 56 and the cap 66 may be contoured correspondingly.

FIG. 15 shows an alternative form of mounting 70 for an encapsulated light source such as the light source 50 of FIGS. 12 and 13. The mounting 70 is a two-piece arrangement moulded from epoxy resin, having a body portion 72 and a cap portion 74. The body portion 72 has a cylindrical receptacle 76 that is externally threaded at an annular end 78 and has a threaded mounting stem 80 at its other end. The cap portion 74 has a cylindrical wall 82 extending from a base 84 thereof, a portion 86 of the inner surface of the wall 82 being threaded for cooperation with the threaded end 78 of the body portion 72.

The encapsulated light source is located in the receptacle 76 of the body portion 72, conveniently by having a pip engage a depression 88 of the receptacle, and the cap portion 74 is screwed into engagement therewith. The annular space then existing between the wall 82 of the cap portion 74 and the outer surface of the receptacle 76 of the body portion 72 is filled with cement, preferably Tensil 7, to form a secure waterproof seal for the mounting of the light source.

Figure 10:
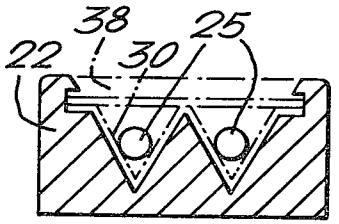
FIG. 10 is a cross-section along line AA of FIG. 6 showing the insert and face-plate in outline mounted in the housing.
Figure 18:
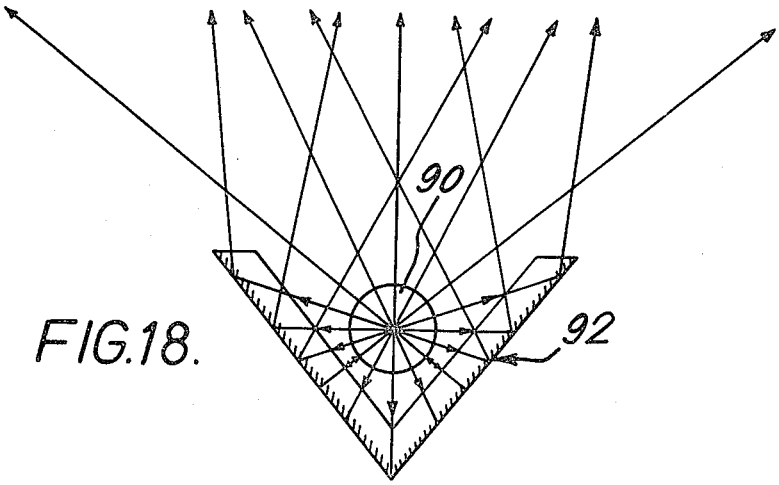

Reference will now be made to FIGS. 16 and 18 for an explanation of the production of light by lamps of the invention, and for convenience, reference is made to the lamp construction of the embodiment shown in FIG. 10.

Figure 17:
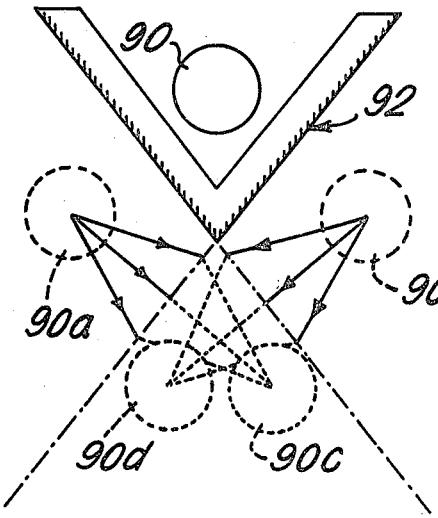

Each light source 25 produces spherical light waves of equal magnitude throughout its total circumference and length. It has been found particularly advantageous for maximising light reflection to arrange that the reflective sides of the groove or insert containing the light source be inclined to each other at an angle of 78°. FIG. 16 shows a light source 90 disposed within a reflective groove 92, and the two primary virtual source images 90*a* and 90*b*. The primary virtual images 90*a,b* themselves produce secondary virtual images 90*c,d* respectively, as shown in FIG. 17. The lines of the reflective surfaces of the groove 92 are shown extended by chain-dotted lines to facilitate understanding of the production of the secondary images.

Figure 19:
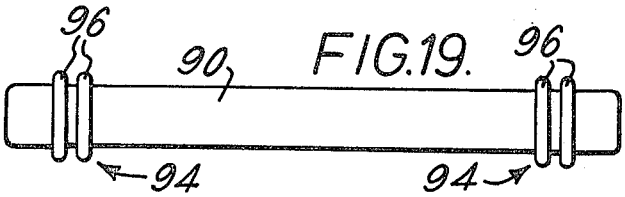
FIG. 19 is a side elevation of a lamp showing its mounting arrangement.

FIG. 16 shows the paths of light rays that are emitted directly from the groove 92 by the source 90, and FIG. 18 shows the enhancement of the light output due to reflection from the groove surfaces. By locating the light source a small distance away from the groove surface, greater reflection is obtained than if there were contact therebetween. To this end, FIG. 19 shows a spacer arrangement 94 for the source 90. The spacer arrangement 94 comprises a pair of O-rings 96 mounted as a stretch-fit over the substantially cylindrical source 90, one adjacent each end thereof. The O-rings 96 are spaced apart by about one eighth of an inch, with the space towards the bottom of the source 90 containing glue, cement, or other adhesive. The source 90 is then placed in the groove 92, and the faceplate of the lamp put into place. The faceplate contacts the O-rings 96 and presses them firmly into contact with the sides of the groove so as securely to locate the source 90. It will be appreciated that this mounting feature may be used in other embodiments herein described.

In addition to providing protection in hyperbaric conditions, the lamp housings of the inventions are preferably explosion proof.

Lamps embodying the invention can also be employed to provide emergency lighting, markers on diving tools and equipment, direction indicators, as on valves, submarine leg penetration indicators, and guide post identification markers.

It will be evident that the present invention can be embodied in a variety of ways other than as specifically described to provide a lamp capable of use underwater for as long as the self-energising light source remains active.

The housing can contain one or any appropriate greater number of self-powered light sources of any available configuration and can be shaped in a variety of ways appropriate to the intended use, to facilitate mounting and preferred deployment of light from the source.

The light reflectors of the lamps hereinbefore described provide V-shaped recesses and, as can be seen from FIG. 17, this produces the impression that there are five discrete sources of light. In some applications, however, it is advantageous to have a diffuse light source, for example where the generally-transparent cover of the source is over-printed with opaque information. In such cases, the reflector is of parabolic or other curved shape.

Although the housing of the lamp has hereinbefore been described as being of acrylic material, it will be appreciated that other material, and particularly epoxy resin, would be suitable.

I claim:

1. An undersea lamp comprising, in combination, a housing body portion having an elongate recess therein, a translucent housing cover portion extending over said recess and permanently sealed to said housing body portion, said elongate recess having a substantially V-shaped transverse section, an elongate light-reflective insert of V-shaped cross-section and length similar to those of said recess and firmly secured in said recess and opening to said translucent cover portion, and an elongate substantially cylindrically shaped self-energising radiation-type light source having a length substantially equal to that of the recess and fixedly mounted in said light-reflective insert in spaced relation to the walls thereof, the combination providing a self-contained lamp unit independent of external power sources and capable of duty in deep sea conditions.

2. A lamp according to claim 1 wherein said light source is spaced from the walls of said insert by four O-rings, said O-rings being located in spaced pairs adjacent each end of the source, and the space between each pair of said O-rings containing an adhesive whereby said source is secured to said walls of said insert.

3. A lamp according to claim 1 wherein said body portion is a substantially rectangular block having the recess in a major surface thereof, and wherein said cover portion is a substantially rectangular plate sealed to said body portion to extend over said prior surface.

4. A lamp according to claim 3 wherein said body portion has an overhanging peripheral lip, and said cover portion is retained beneath said lip.

5. A lamp according to claim 1 wherein said housing portions are of acrylic resin.

6. A lamp according to claim 5 wherein said body portion and said cover portion are welded together.

7. A lamp according to claim 5 wherein the body portion and the cover portion are cemented together.

8. A lamp according to claim 2 wherein said housing cover and body are shaped to compress said O-rings to retain the light source firmly therebetween.

9. A lamp according to claim 1 wherein the sides of the recess are inclined to each other at an angle of between 70° and 80°.

10. A lamp according to claim 8 wherein the said angle is 78°.

11. A lamp according to claim 1 having four of the light sources each received in said insert in a respective said recess.

12. A lamp according to claim 1 having means between said housing portions adapted to provide a shock absorbent mounting for said light source.

* * * * *